US005659981A

United States Patent [19]

Liautaud

[11] Patent Number: 5,659,981

[45] Date of Patent: Aug. 26, 1997

[54] SNOWSHOE

[76] Inventor: Jeffrey T. Liautaud, 431 S. Western, Park Ridge, Ill. 60068

[21] Appl. No.: 533,189

[22] Filed: Sep. 25, 1995

Related U.S. Application Data

[63] Continuation of Ser. No. 239,268, May 6, 1994, abandoned.

[51] Int. Cl.[6] ..... A43B 5/04

[52] U.S. Cl. ..... 36/122; 36/125

[58] Field of Search ..... 36/116, 122, 123, 36/124, 125

[56] References Cited

U.S. PATENT DOCUMENTS

| | | | |
|---|---|---|---|
| 1,004,900 | 10/1911 | Pease . | |
| 2,511,087 | 1/1950 | Villemur . | |
| 2,738,596 | 3/1956 | Walsh . | |
| 3,596,374 | 8/1971 | Covington | 36/125 |
| 3,638,333 | 2/1972 | Sprandel . | |
| 3,744,162 | 7/1973 | Beck | 36/125 |
| 3,802,100 | 4/1974 | Prater | 36/124 |
| 4,085,529 | 4/1978 | Merrifield | 36/125 |
| 4,259,793 | 4/1981 | Morgan, Jr. et al. | 36/125 |
| 4,720,928 | 1/1988 | Faber et al. | 36/122 |
| 5,253,437 | 10/1993 | Klebahn et al. | 36/122 |

FOREIGN PATENT DOCUMENTS

| | | | |
|---|---|---|---|
| 2059819 | 8/1992 | Canada | 36/122 |
| 2829853 | 2/1979 | Germany | 36/122 |

OTHER PUBLICATIONS

Norther Lites, Inc., "How Northern Lites Have Completely Redefined Every Measure of Snowshoe Performance", pp. 1–4.

Redfeather Design, Inc., "Redfeather Snowshoes and Accessories", pp. 1–6.

ForrestSmith, "User Friendly Modular Snowshoes for the 90's", pp. 1–4.

YubaShoe Sport Snowshoes, "Snowshoe Category Planagram", pp. 1–2, 1994.

Cole Alpine Manufacturing, "Cole Alpine Shoes", pp. 1–3, 6–31–93.

ATLAS Snow–Shoe Company, "Americas Finest Snowshoes", pp. 1–3, 1993.

*Primary Examiner*—M. D. Patterson
*Attorney, Agent, or Firm*—Michael, Best & Friedrich

[57] ABSTRACT

A snowshoe includes a perimeter frame carrying sheet-type floatation and having a hinge rod secured transversely of the frame by hinge rod straps. A foot plate is pivotally mounted on the hinge rod and supports a binding to attach the snowshoe to a user's shoe or the like. A bearing sleeve is disposed between the hinge rod and a retainer plate secured to the underside of the foot plate. The hinge rod, bearing sleeve, retainer plate, and hinge rod straps, act independently or cooperatively to vary the frictional resistance to relative rotation between the foot plate and hinge rod, and thereby provide a shock absorber effect. Various features enable variation of the shock absorbing characteristics to accommodate different uses of the snowshoe and different characteristics of the user. Other features provide improved discharge of snow which accumulates on the snowshoe, and improved retention of the user's boot longitudinally within the binding.

28 Claims, 3 Drawing Sheets

SNOWSHOE

This is a continuation of application Ser. No. 08/239,268, filed 1994 May 6, now abandoned.

BACKGROUND OF THE INVENTION

The present invention relates generally to snowshoes, and more particularly to a novel snowshoe having improved performance over prior snowshoes.

Snowshoes have traditionally been used as a convenient means to traverse relatively deep snow. With the increased interest in outdoor activities, such as hiking and the like, the use of snowshoes in the backcountry has grown significantly. More recently, there has been increased interest in running or jogging on snowshoes, including the holding of races with the runners wearing snowshoes. Racing events have special requirements. For example, each runner's snowshoes must meet certain minimum size standards in width and length, generally 8" wide and 25" in length. Further, in running on snowshoes it is highly desirable that any articulated movement between the snowshoe and the runner's foot or boot be controlled so as to prevent rotation of the snowshoe to a position wherein the toe end of the snowshoe engages the user's shin or ankle, and also prevent rotation in an opposite direction to a point where the tail end of the snowshoe effects a shock-like slapping of the snowshoe against the user's foot when the snowshoe is lifted from the surface of the snow.

Conventional snowshoes have a frame which forms the perimeter of the snowshoe and is generally made of wood or a tubular lightweight metal such as aluminum. The perimeter frame may be reinforced by transverse cross bars and has floatation means secured thereto, such as a traditional webbing laced tight to the frame. Early snowshoe designs provided for relatively loose attachment of the snowshoe to the user's foot so that sideways slop was allowed between the snowshoe and the user's boot. More recent snowshoe designs employ a hinge rod which is fixed transversely to the frame to underlie the ball of the user's foot. The hinge rod pivotally supports a relatively rigid foot or claw plate through a retainer plate secured to the foot plate. A binding to receive the user's shoe or boot is secured to the top of the foot plate and one or more cleats or calks are preferably fixed to the bottom of the foot plate to provide better gripping when traversing packed snow or ice. A tubular bearing, such as a plastic sleeve or bushing, is preferably coaxial on the hinge rod to minimize friction between the hinge rod and its pivotal connection to the foot plate. A snowshoe of this general construction is disclosed in U.S. Pat. No. 3,802,100 which is incorporated herein by reference.

While snowshoes of the aforedescribed type have performed satisfactorily in backcountry snowshoeing, they lack optimum performance characteristics desired in snowshoes used in jogging or running on packed snow. In backcountry snowshoeing in relatively deep powder, it is important that vertical lift of the tail of the snowshoe be minimized since snow generally accumulates on top of the snowshoe tail and thereby requires greater expenditure of energy to lift the snowshoe with each step taken. Thus, snowshoes intended for backcountry snowshoeing generally enable the user's foot to freely pivot about the hinge rod so that the toe of the snowshoe comes up off the snow while the tail drags along the snow surface. This provides minimal lifting of the snowshoe upon pivotal movement of the user's foot during a forward step.

Running or jogging on snowshoes of the aforedescribed type, particularly on packed snow, is generally made more difficult by the free pivot and the relative ease with which the foot plate pivots about the hinge rod on a snowshoe intended for backcountry use. As the jogger or runner takes each step, the foot initially pivots forwardly followed by lifting of the snowshoe so that the forward and tail ends lift off the surface of the snow. With prior snowshoes, as the snowshoe is lifted from the snow surface, the toe end may slap against the user's shin with a resultant bruise and soreness. To prevent such action, prior snowshoes have employed a strap having one end fixed to the frame of the snowshoe generally adjacent its tail end and having an opposite end secured to either the trailing end of the foot plate or adapted for connection to the binding holding the user's boot or shoe. The strap limits angular rotation of the snowshoe frame relative to the foot plate to an included angle of approximately 45°. This technique, however, has a significant disadvantage in that the strap causes the frame and floatation webbing to lift off the snow and continue forward with considerable momentum that results in a snap or slap against the user's heel. The resulting slapping noise is annoying in addition to imparting an undesirable upward force on the user's foot. This force takes energy away from the runner as the runner moves his foot back to its natural position.

SUMMARY OF THE INVENTION

One of the primary objects of the present invention is to provide a novel snowshoe which overcomes the shortcomings of prior snowshoes.

A more particular object of the present invention is to provide a novel snowshoe which lends itself to use in backcountry deep powder snowshoeing as well as use in running or jogging on relatively packed snow.

Another object of the present invention is to provide a novel snowshoe having shock absorbing means which provides a controlled pivotal relation between the snowshoe frame and the foot plate so as to prevent the toe end of the frame from hitting the user's ankle or shin, and also prevent the tail end of the snowshoe from slapping against the user's heel.

Still another object of the invention is to provide a novel snowshoe as described wherein the shock absorbing means is established by forming a cooperative relation between the foot plate and the hinge rod so that there is relatively little frictional resistance to initial upward pivotal movement of the foot plate about the hinge rod relative to the snowshoe frame, but significantly increased resistance to such pivotal movement when the foot plate approaches a pivot angle of approximately 45° with the frame. The increasing resistance to relative pivotal movement between the foot plate and snowshoe frame acts as a shock absorber to dampen the tendency of the frame carried floatation means to slap against the user's foot as experienced with prior snowshoes during jogging or running. This action also inhibits the toe or forward end of the snowshoe frame from free rotation with resulting striking of the user's shin or ankle.

Yet another object of a preferred embodiment of the present invention is to provide a novel snowshoe as aforedescribed wherein the shock absorbing means may be adjusted to accommodate varying characteristics of users, such as experience, size and overall snowshoeing ability, and the particular use intended for the snowshoe, such as backcountry powder or jogging and running on packed snow.

Another object of the present invention is to provide a novel snowshoe of the type having sheet-like floatation means secured to a perimeter frame having a runner cutout, and wherein the floatation means extends substantially the full length of the frame.

Another object of the present invention is to provide a novel snowshoe of the type having sheet-like floatation means secured to a perimeter frame and wherein the floatation means is operative to allow snow which accumulates on the floatation means to pass downwardly interiorly of the frame as it is lifted during each successive step.

Still another object of the snowshoe in accordance with the present invention lies in the provision of a binding adapted to receive the forward portion of the user's shoe or boot, and having a toe piece adapted to be drawn snugly against the toe of the boot by a strap which is then secured about the heel portion of the boot to securely retain the boot longitudinally in the binding.

In carrying out the present invention, a snowshoe is provided which, in its preferred embodiment, includes a lightweight tubular metallic frame that defines the perimeter of the snowshoe and has a runner cutout at the tail end of the frame. A closed sheet-like floatation means is secured interiorly of the frame and enables the frame to resist downward movement into powder snow. A hinge rod has its opposite ends secured to the frame so that the hinge rod extends transversely of the frame and underlies the position assumed by the ball of the user's foot. A low friction tubular bearing sleeve or bushing is preferably coaxial about the hinge rod and is interposed between the hinge rod and a generally U-shaped retainer plate that is secured to the lower surface of a foot plate and establishes a pivotal connection between a forward end of the foot plate and the hinge rod. A binding is secured to a top surface of the foot plate to facilitate attachment of the snowshoe to a user's shoe or boot.

The portion of the hinge rod about which the bearing sleeve is disposed has a non-circular transverse cross-sectional configuration so as to define at least one outwardly facing cam surface, and preferably a pair of cam surfaces. The configuration of the hinge rod and its orientation relative to the snowshoe frame, coupled with the configuration of the retainer plate and foot plate, are such that the foot plate encounters relatively minimal resistance to rotation or pivotal movement about the hinge rod during initial upward pivot movement of the heel portion of the user's foot to initiate each successive step of the snowshoe. As upward pivotal movement of the foot plate begins to approach an angular position of approximately 45° relative to the perimeter frame, the cam surfaces on the hinge rod cooperate with the bearing sleeve and retainer plate to significantly increase frictional resistance to continued upward pivotal movement of the foot plate. At this time, continued movement of the user's foot and leg in a forward stepping action lifts the snowshoe from the snow surface. The increased resistance to upward pivotal movement of the foot plate also serves to bias the snowshoe to remain in its angular relation to the foot plate and user's foot during lifting so as to prevent or dampen any tendency of the snowshoe frame to freely rotate about the hinge rod and slap against the user's heel. In this manner, a shock absorbing action is achieved which substantially prevents the tail of the snowshoe from imparting impact forces against the user's heel, and prevents the toe of the snowshoe from engaging the user's shin or ankle. Cleats or calks are preferably formed on the lower surface of the foot plate to facilitate gripping of the snowshoe with the snow as the other snowshoe is moved forwardly.

The shock absorbing characteristics of the snowshoe in accordance with the present invention are further enhanced by connecting the ends of the hinge rod to the perimeter frame through hinge rod straps which couple with looped ends of the hinge rod. The hinge rod straps undergo a twisting action about their longitudinal axes in response to rotation of the hinge rod when the foot plate reaches an upward pivotal position of approximately 45° relative to the frame. The twisting action of the hinge rod straps further enhances the shock absorbing characteristic by increasing resistance to rotation of the hinge rod as the foot plate pivots upwardly, thereby significantly absorbing pivotal or twisting moment forces which would otherwise be imparted to the frame by the hinge rod and cause the tail of the snowshoe to slap upwardly against the user's foot.

The hinge rod, bearing sleeve and retainer plate, in cooperation with the foot plate, define shock absorber elements which can be independently varied to vary the shock absorbing characteristics of the snowshoe to accommodate different uses of the snowshoe and different characteristics of the user. One example is to vary the wall thickness of the bearing sleeve so as to vary the frictional resistance to pivotal movement of the foot plate relative to the snowshoe frame. A relatively thin walled bearing sleeve will enable relatively free pivotal movement of the foot plate about the hinge rod as may be desired in backcountry snowshoeing. In jogging or running, it may be desirable to inhibit pivotal movement of the foot plate about the hinge rod so that the snowshoe does not flop around and slap against the user's foot or engage the user's shin or ankle. In this case, a thicker wall bearing sleeve would be used.

A feature of the snowshoe in accordance with the present invention lies in providing floatation means in the form of an impervious high strength sheet material which extends substantially the full length of the perimeter frame and is connected to the frame in a manner to enable discharge of snow accumulated on the tail end of the snowshoe during each successive step. This is advantageous for backcountry snowshoeing in powder snow because it reduces the load of snow carried on the snowshoe. It is also advantageous to runners who tend to throw snow over onto themselves as their snowshoe rotates upward and strikes their heels.

Another feature of the snowshoe in accordance with the present invention lies in the use of a pair of connector loops which are looped in overlapping relation to each other at the center of the tail and prevent lateral movement of the floatation surface to which they are attached.

Further objects, features and advantages of the snowshoe in accordance with the present invention will become apparent from the following detailed description taken in conjunction with the accompanying drawings wherein like reference numerals designate like elements throughout the several views.

DETAILED DESCRIPTION

Figure 1:
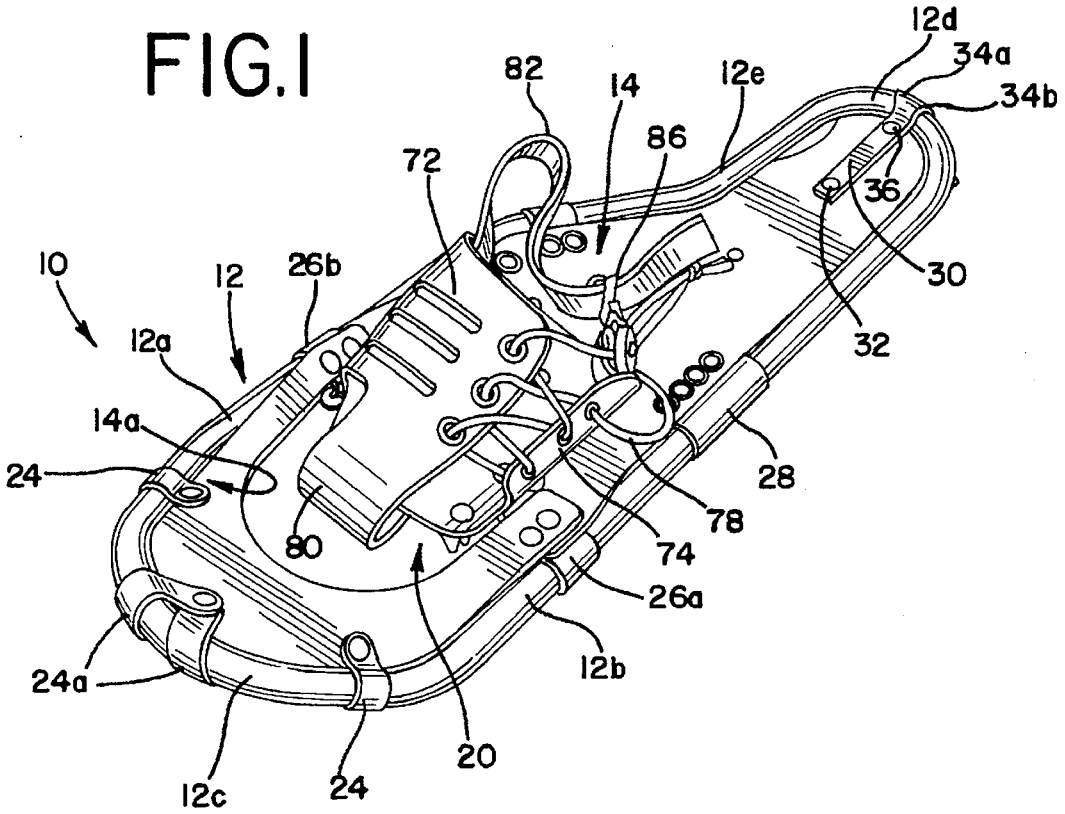
FIG. 1 is a perspective view of a snowshoe constructed in accordance with the present invention.
Figure 2:
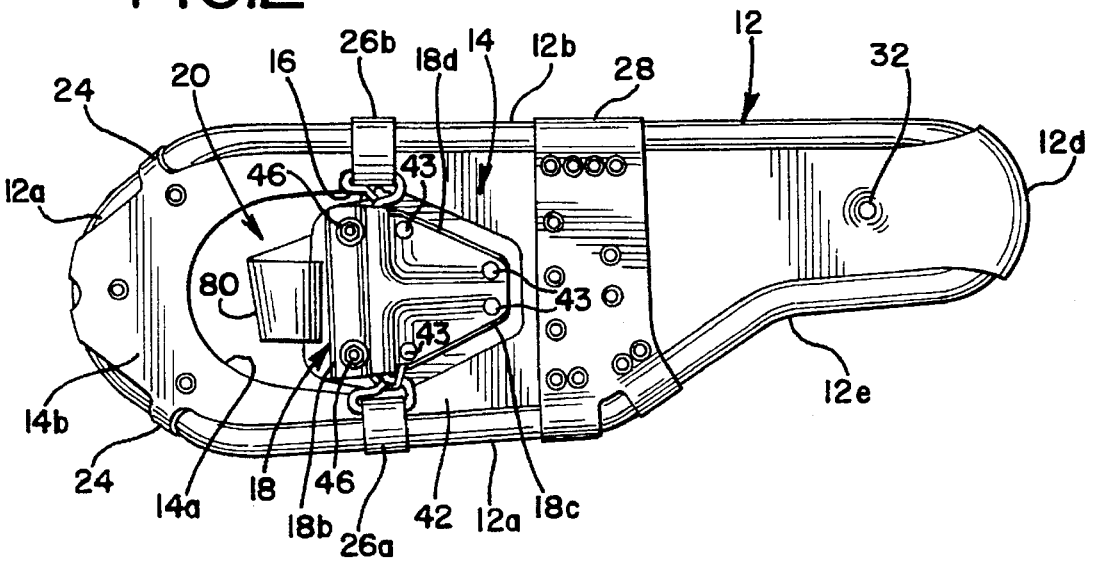
FIG. 2 is a bottom view of the snowshoe of FIG. 1.
Figure 3:
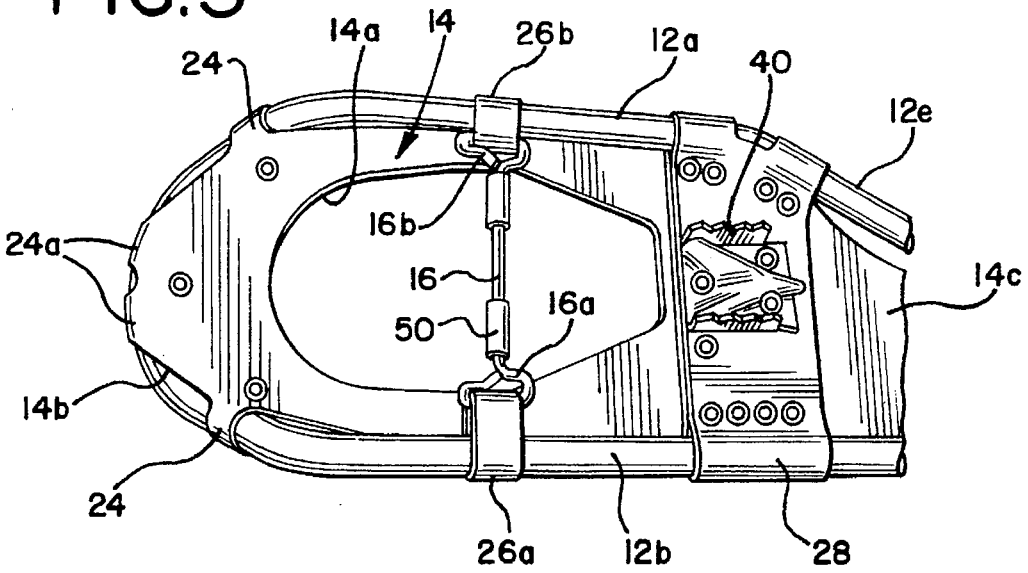
FIG. 3 is a fragmentary bottom view of a snowshoe to be worn on the right foot but with the foot plate and binding removed and the bearing sleeve broken away for clarity.

Referring now to the drawings, and in particular to FIGS. 1–3, a snowshoe constructed in accordance with a preferred embodiment of the present invention as indicated generally at 10. Briefly, the snowshoe 10 includes perimeter frame means 12 to which is affixed floatation means 14 that extends substantially the full longitudinal length of the frame means. The floatation means 14 facilitates support of the snowshoe on powder snow, as is known. Hinge rod means in the form of a hinge rod 16 (FIG. 3) has its opposite ends secured to the frame means 12 so as to extend transversely of the frame means across an opening 14*a* in the floatation means. The hinge rod 16 is positioned to underlie the ball of a user's foot when the snowshoe is attached to the user's shoe or the like. As will be described, the hinge rod 16 pivotally supports a foot plate means which includes a foot plate 18, alternatively termed a claw plate or binding support plate, in a manner to enable pivotable movement of the foot plate between a position generally coplanar with the frame means 12 and an upward pivotable position forming an included angle of approximately 45° with the plane of the adjacent frame means.

Figure 8:
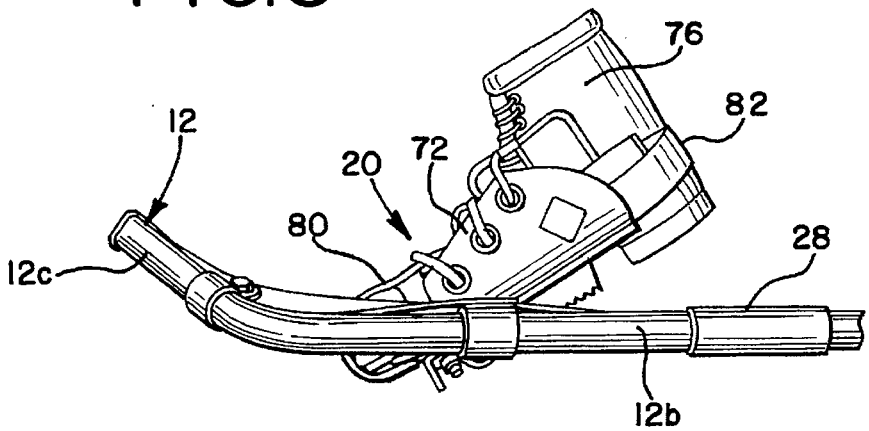
FIG. 8 is a fragmentary side elevational view showing the foot plate and binding in an upwardly pivoted position relative to the snowshoe frame.

The foot plate or binding support plate 18 supports binding means, indicated generally at 20, which is affixed to an upper generally planar surface of the foot plate and facilitates attachment of the snowshoe to a user's shoe or the like, as illustrated in FIG. 8. The snowshoe 10 illustrated in FIGS. 1 and 2 comprises one of a pair of snowshoes which are virtual mirror images of each other, the snowshoe 10 being intended to be worn on the user's left foot.

Turning now to a more detailed description of the snowshoe 10, the frame means 12 is preferably made of a suitable strength, non-corrosive, lightweight tubular metallic material, such as aluminum. If desired, the frame means 12 may also be made from other materials such as wood or suitable strength plastic. The frame means 12 forms a closed loop having inner and outer coplanar side rail portions 12*a* and 12*b*, respectively, which establish a lateral width of approximately 8 inches for the snowshoe 10. The side rail portions 12*a* and 12*b* terminate at their forward ends in a forward rounded end frame portion 12*c*. The end portion 12*c* is inclined upwardly relative to the plane of the side rails at an angle of inclination of approximately 45° so as to increase upward floatation in powder snow. The side rail frame portions 12*a* and 12*b* terminate at their rearward ends in a rounded tail end frame portion 12*d* so as to establish a longitudinal length of approximately 25 inches for the snowshoe, although other length snowshoes may also be desired. The inner rail is curved inwardly to form an angled portion. The inner rail 12*a* is curved inwardly at 12*e* to provide a reduced width tail end, termed a short step or runner cutout, which is particularly desirable to reduce contact between snowshoes when jogging or running.

In the illustrated embodiment, the floatation means 14 comprises a suitable snow and water impermeable sheet material which preferably is relatively lightweight but has sufficient tear and shear resistance for its intended purpose. The floatation means 14 is particularly adapted for back-country snowshoeing in powder snow but also finds application on running snowshoes because of its light weight. The floatation means 14 may be formed from 1000 denier nylon coated on its bottom surface with an abrasion resistant polyurethane. The top surface of the floatation means is generally not exposed to abrasive snow or other ground materials and may be coated with a suitable plastic material, such PVC. Other suitable strength materials could also be used to form the floatation means 14, including traditional webbing laced tightly to the frame 12.

The floatation sheet material includes a forward portion 14*b* which partially defines the opening 14*a* and is secured to the forward curved end 12*c* of the frame means 12 by lacing, or alternatively with a plurality of loops 24 as illustrated in FIGS. 1 and 2. The loops 24 are preferably formed integral with the floatation sheeting material and secured around the frame with suitable fasteners, such as rivets or the like. A pair of forwardmost loops 24*a* are looped about the frame and angled back upon the floatation sheet material in overlapping relation to each other where they are secured with a common rivet or fastener to the floatation material so as to prevent lateral movement of the floatation sheet material. The trailing ends of the forward floatation sheet portion 14*b* are secured to hinge rod straps 26*a* and 26*b*, respectively, which loop about the lateral side rails of the frame means 12.

A rearward portion 14*c* of the floatation sheet material extends from the hinge rod straps 26*a,b* to the trailing end 12*d* of the frame means. The floatation sheet portion 14*c* defines the rearward edge of opening 14*a* and has a peripheral outer contour substantially equal to the planar contour of the rearward portion of the frame means. The floatation sheet material 14*c* overlies and is secured to a broad transverse support strap 28 through a plurality of suitable fasteners, such as rivets. The transverse support strap 28 is made of a similar high strength coated nylon material and provides lateral strength or reinforcement for the frame as well as supporting the weight of the user beneath the heel portion of the user's boot.

The trailing end of the floatation sheet 14*c* is secured to the curved end portion 12*d* of the frame means through an elongated strap 30 having a forward end fixed to the floatation sheet material through a fastener 32. A rearward end of strap 30 is connected to a pair of connector straps 34*a* and 34*b* by a fastener 36. The connector straps 34*a* and 34*b* are looped about the curved frame end 12*d* in generally side-by-side relation and have the ends secured in overlapping or superimposed relation to each other and to the tail end of the strap 30 by the fastener 34. The looped connector straps 34*a,b* prevent lateral movement of the strap 30.

Figure 6:
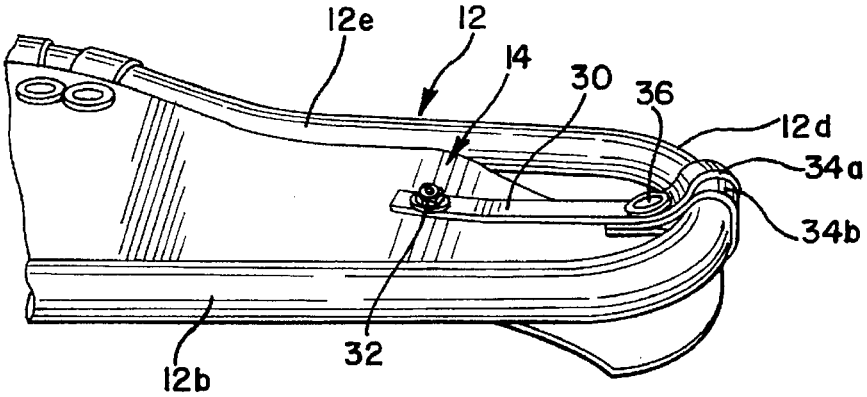
FIG. 6 is a fragmentary perspective view illustrating the tail end of the floatation sheet in a snow discharge position.

As illustrated in FIGS. 2 and 6, the trailing end of the floatation sheet material 14*c* is of sufficient length to underlie the curved end 12*d* of the frame means so as to be pressed against the frame and assist in supporting the snowshoe on a snow surface. When the snowshoe is lifted from the snow surface, the end of the floatation sheet 14*c* rearwardly from the fastener 32 an drop downwardly by gravity to discharge any snow which has accumulated on the snowshoe interiorly of the frame. Snow on the tail end of the snowshoe will also rearwardly and forwardly of the fastener 32 drop between the lateral edges or side perimeter edge portions of the floatation sheet and the side rail portions of the frame 12. Referring to the drawings in FIG. 2 , it is clear that there is no structural support on the tail end preventing a gravity release of snow along the sides from the tail strap fastener 32 to the wear pad attachment at 28 with four rivets. The limit of structural support to the floatation sheet lies on a line drawn from the joining of the wear pad 28 at the four rivets to the tail strap fastener 32. A study of the forces on the tail end of the floatation sheet reveals that the side perimeter will release snow on the rail side, or floatation portion, of such a line because it is unsupported. The floatation portion is released from the frame for dropping beneath the frame. The snow on the floatation portion will be released forwardly and rearwardly of the fastener 32 when the snowshoe is lifted from the ground.

The foot plate or binding support plate 18 is generally trapezoidal shaped in plane configuration and may be made of a suitable strength corrosion resistant material such as aluminum or stainless steel. The foot plate 18 has a generally planar plate portion 18*a* the upper surface of which supports the binding means 20 as will be described. A forward transverse edge of the planar plate portion 18*a* preferably has a downwardly directed right-angle wall 18*b* having a toothed or serrated lower edge which defines a plurality of cleats or calks that extend below the lower plane of the frame means 12 when the foot plate is generally coplanar with the side rails of the snowshoe frame means. Laterally opposite rearwardly converging marginal edges of the planar plate portion 18*a* of the foot plate are also preferably similarly formed with downwardly directed right-angle walls 18*c* and 18*d* which also have serrated lower edges forming cleats or calks that extend below the frame means when the foot plate is generally coplanar with the side rails. The cleats or calks are preferably provided on the foot plate to provide improved traction when traversing hard packed snow. If desired, a rear claw, indicated at 40 in FIG. 3, may be secured to the lower surface of the transverse support web 28 and has similar downwardly projecting cleats or calks to prevent the trailing end of the snowshoe from sliding laterally on hard packed snow or when traversing inclined slopes. The lower exposed surface of the foot plate 18 is preferably covered with a sheet 42 of flexible coated nylon to inhibit adherence of snow to the foot plate, the nylon sheet being secured to the foot plate through rivet fasteners, such as indicated at 43 in FIGS. 2 and 4.

Figure 5:
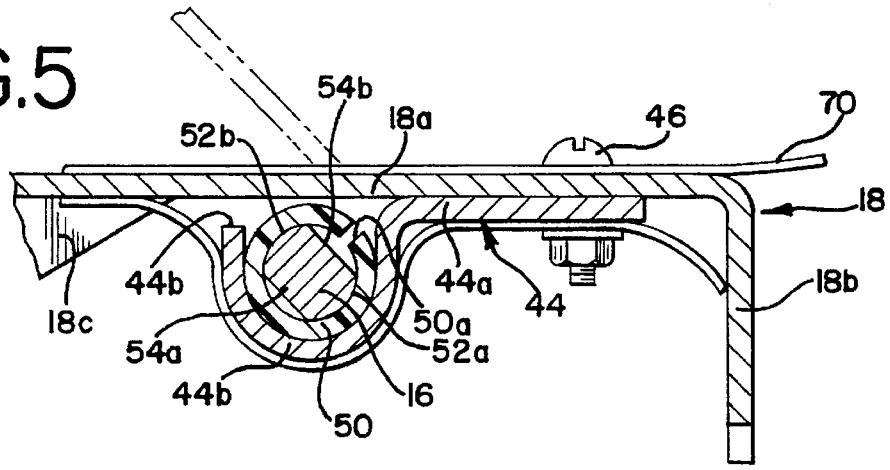
FIG. 5 is a fragmentary longitudinal sectional view, on an enlarged scale, illustrating the pivotal mounting arrangement of the foot plate on the hinge rod.

The foot plate means also includes retainer plate means in the form of a retainer plate 44 which, as illustrated in FIG. 5, is secured to the lower surface of the planar portion 18*a* of the foot plate 18. The retainer plate 44 includes a planar plate portion 44*a* and a U-shaped portion 44*b*. The planar portion 44*a* is releasably secured to its lower surface by fastener means in the form of a plurality of screws and locknuts 46 which enable selective loosening of the retainer plate 44 relative to the foot plate. The retainer plate 44 is secured to the foot plate 18 so that the U-shaped portion 44*b* extends transversely of the foot plate. Both the foot plate 18 and retainer plate 44 have transverse widths substantially equal to the length of the hinge rod 16 between oblong looped ends 16*a* and 16*b* formed on opposite ends of the hinge rod, as illustrated in FIG. 3.

As aforedescribed, the hinge rod 16 is secured to the laterally opposite side rails 12*a* and 12*b* of the frame means 12 so as to extend transversely of the longitudinal axis of the frame means at a position to substantially underlie the ball of the user's foot to which the snowshoe is attached. The hinge rod 16 is preferably attached to the side rails 12*a* and 12*b* by means of the hinge rod straps 26*a* and 26*b* which are looped through the corresponding looped ends of the hinge rod. The hinge rod straps have substantially greater transverse width than thickness and are preferably formed of a high strength woven nylon base fabric having a coating of polyurethane on the opposite side surfaces, and with a thicker bead of polyurethane along their perimeter edges to resist wear. The straps are looped about their respective frame side rails and the looped ends of the hinge rod 16 so that the hinge rod straps firmly secure the hinge rod to the frame.

Prior to assembling the foot plate 18 and retainer plate 44 onto the hinge rod 16, bearing sleeve means in the form of a low friction bearing sleeve 50, which may be made of polyethylene and alternatively termed a hinge rod bushing, is assembled in coaxial relation about the longitudinal length of the hinge rod. To facilitate assembly of the bearing sleeve or rod bushing 50 over the hinge rod 16, the bearing bushing is preferably slit along its longitudinal length, as indicated at 50*a* in FIG. 5. As will be described, one feature of the snowshoe 10 is the ability to readily change the bearing sleeve 50 so that bearing sleeves of different wall thicknesses may be utilized to vary the resistance to rotational or pivotal movement of the foot plate about the longitudinal axis of the hinge rod.

Referring again to FIG. 5, in assembling the foot plate 18 onto the hinge rod 16, the retainer plate 44 is placed about the hinge rod and bearing sleeve so that they are received within the U-shaped portion 44*b* of the retainer plate. The retainer plate 44 is then secured to the foot plate through the screws 46 and associated locknuts. The U-shaped portion 44*b* has a fixed nominal radius of curvature and has a free marginal edge 44*b* which extends parallel to the axis of curvature of the U-shaped portion 44*b* and is spaced from the lower surface of the planar portion 18*a* of the foot plate in parallel relation thereto.

In accordance with one feature of the snowshoe 10, the hinge rod 16, bearing sleeve or rod bushing 50, and retainer plate 44 define shock absorber element means which can be independently varied to vary the frictional resistance to pivotal movement of the foot plate about the axis of the hinge rod. These independent shock absorber elements cooperate with the foot plate 18 to enable relatively free initial upward pivotal movement of the foot plate about the hinge rod but substantially dampens any tendency of the snowshoe to rapidly pivot about the hinge rod 16 when the snowshoe is lifted off the snow surface as in jogging or running on snowshoes. The cooperative shock absorber means prevents or inhibits the forward end of the snowshoe from engaging the user's ankle or shin and also prevents the tail end of the snowshoe from slapping against the heel of the user's boot. As will be described, the cooperative shock absorber means also stabilizes the snowshoe relative to the user's foot so as to enable backstepping when an obstacle is encountered, as in backcountry snowshoeing.

In the illustrated embodiment, the length of the hinge rod 16 between its oblong looped ends 16*a* and 16*b* is formed with a non-circular cross section so as to define at least one, and preferably a pair of cam surfaces 52*a* and 52*b* which effect progressively increasing frictional resistance to pivotal movement of the foot plate 18 relative to the frame means 12 as the tail end of the foot plate pivots upwardly about the hinge rod. In the illustrated embodiment, the cam surfaces 52*a* and 52*b* are formed as diametrically opposed outwardly facing arcuate segments of a cylinder the axis of which coincides with the longitudinal axis of the hinge rod. The arcuate cam surfaces 52*a* and 52*b* are interconnected by laterally opposite generally planar surfaces 54*a* and 54*b* which are equally spaced from the longitudinal axis of the hinge rod and may be defined as chord surfaces on the hinge rod.

The cam surfaces 52*a,b* and planar surfaces 54*a,b* are formed on the hinge rod so that the planar surfaces 54*a,b* normally lie in parallel planes forming included angles of approximately 45° with the plane of the side frame rails 12*a* and 12*b*, as illustrated in FIG. 5. The diametrical distance between the cam surfaces 52*a* and 52*b*, coupled with the wall thickness of the bearing sleeve or rod bushing 50, the radius of curvature of the U-shaped portion 44*b* of the retaining plate 44, and the distance between the center axis of U-shaped portion 44*b* and the foot plate planar portion 18*a* establish a geometrical relation enabling relatively free upward pivotal movement of the trailing end of the foot plate about the hinge rod during initial upward pivotal movement from its lowered position generally coplanar with the side rails 12*a* and 12*b* of the frame means. As the foot plate approaches an upward pivotal position defining an included angle of approximately 45° with the plane of the frame side rails 12*a* and 12*b*, relative rotation between the retaining plate 44 and the hinge rod 16 causes the cam surfaces 52*a* and 52*b* to effect increased frictional resistance to upward rotation or pivotal movement of the foot plate about the hinge rod. By controlling the wall thickness of the bearing sleeve or rod bushing 50, the frictional resistance to relative pivotal movement between the foot plate and the hinge rod 16 can be varied. When employing a hinge rod having cam surface means, such as the cam surfaces 52*a* and 52*b*, the frictional resistance to relative rotation between the foot plate and hinge rod can be varied to provide progressively increased frictional resistance as the foot plate approaches a pivotal angle of approximately 45° relative to the frame of the snowshoe. In this condition, as the user raises the snowshoe frame and floatation means from the surface of the snow, which generally occurs when jogging or running on snowshoes, the increased frictional resistance to rotation of the foot plate relative to the frame means prevents the frame means from freely rotating or flopping about the axis of the hinge rod with possible engagement of the toe portion of the snowshoe against the shin or ankle of the user. Similarly, this action prevents snapping of the tail end of the snowshoe against the user's heel and thus acts as a shock absorber to prevent annoying noise and imparting of an impact force against the user's heel.

Conversely, as the snowshoe is moved forwardly with the foot plate 18 in its upward pivotal position relative to the frame means 12, and with the frame means and floatation means 14 raised from the surface of the snow, as in jogging or running, resistance to downward pivotal movement of the foot plate and user's foot relative to the frame decreases as the snowshoe is lowered to again engage the surface of the snow. This is due to the interaction of the hinge rod cam surfaces with the retainer plate 44, bearing sleeve 50 and planar portion 18*a* of the foot plate which tends to bias the hinge rod to its original position wherein the foot plate is again generally parallel to the plane of the frame side rails 12*a* and 12*b*. In this manner, resistance to downward pivotal movement of the foot plate and user's foot relative to the frame is reduced sufficiently that as the user's foot approaches the snow surface, substantially full surface engagement of the snowshoe with the snow surface is effected.

It will be appreciated that with the hinge rod 16 having a cross-sectional configuration as described, and with the U-shaped portion 44*b* of the retaining plate 44 being fixed relative to the foot plate 18, varying the wall thickness of the bearing sleeve or rod bushing 50 will vary the frictional relation between the hinge rod and the foot plate throughout the full range of pivotal movement of the foot plate. Thus, use of a relatively thin wall bearing sleeve or bushing will result in relatively little resistance to pivotal movement of the foot plate about the hinge rod. This condition is particularly desirable in backcountry powder snowshoeing wherein it is desired that the tail end of the snowshoe remain on the snow surface so that the user does not waste energy lifting snow which has accumulated on top of the snowshoe. In jogging or running on snowshoes, the user may wish to inhibit the freedom of pivotal movement of the foot plate about the hinge rod so that the snowshoe does not flop around or slap against the user's foot or engage the user's shin or ankle. In this case, a thicker wall bearing sleeve or bushing would be selected to increase the frictional resistance to pivotal movement of the frame means relative to the foot plate and user's boot when the snowshoe is raised from the snow surface.

It will also be appreciated that the frictional relation between the foot plate 18 and the hinge rod 16 may be varied by loosening the screws and locknuts 36. This will vary the gap or spacing between the center of curvature of the U-shaped portion 44*b* of the retainer plate 44 relative to the lower surface of the foot plate 18, thereby lessening the resistance to rotation of the foot plate about the hinge rod. The specific size of dimensions of the retainer plate can also be varied to change the frictional resistance to relative rotation between the foot plate and hinge rod. Increasing the radius of curvature of the U-shaped portion 44*b* of the retainer plate will reduce or increase frictional resistance to rotation of the foot plate about the hinge rod.

The frictional resistance to pivotal movement of the foot plate about the hinge rod 16 may also be varied by changing the contour of one or both of the cam surfaces 52*a* and 52*b*. For example, the cam surfaces may be contoured to provide progressively increasing resistance to upward pivotal movement of the foot plate about the hinge rod as the foot plate pivots from its lower position to an upward pivotal angle of approximately 45° relative to the frame of the snowshoe.

The frictional resistance to relative rotation between the foot plate 18 and hinge rod 16 can also be varied when employing a cylindrical hinge rod which does not have cam surface means formed on it. In this case, a bearing sleeve 50 is selected with a wall thickness that will provide the desired frictional resistance to rotation of the foot plate about the hinge rod. A thin wall bearing sleeve will provide less frictional resistance than a thicker wall bearing sleeve, for a given hinge rod diameter and given radius of curvature of the U-shaped portion 44*b* of the retainer plate 44.

Figure 4:
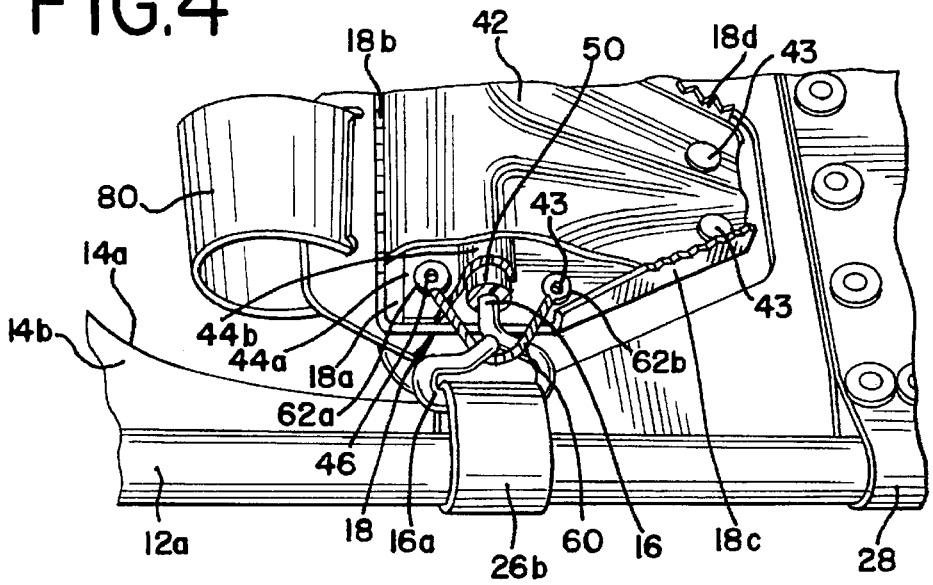
FIG. 4 is a fragmentary bottom perspective view illustrating the bridle strap in cooperation with the foot plate and hinge rod, portions being broken away for clarity.

Bridle means in the form an elongated generally non-extensible flexible member 60 is cooperative with the foot plate 18 and hinge rod 16 so as to limit upward pivotal movement of the foot plate about the hinge rod. The flexible member 60 preferably comprises a relatively high strength corrosive resistant metallic substance having eyelets 62*a* and 62*b* fixed to its opposite ends. As illustrated in FIG. 4, the opposite ends of the bridle cable 60 are fixed to the lower side of the foot plate on opposite sides of the hinge rod 16 through one of the screws 46 and one of the rivets 43 with the bridle cable passing through the corresponding oblong looped end 16*a* of the hinge rod illustrated. The bridle cable 60 has a length which enables the foot plate 18 to pivot or rotate upwardly about the hinge rod through a rotational angle of approximately 45° at which time the bridle cable is placed in axial tension and cooperates with the looped end 16*a* of the hinge rod to prevent further upward pivotal rotation of the foot plate about the hinge rod. The bridle cable 60 is particularly desirable when the snowshoe is used in running to insure that the tail of the snowshoe lifts off the snow surface when the foot plate 18 and user's foot reach an upward angle of approximately 45° relative to the snow surface.

As aforedescribed, the hinge rod straps 26*a* and 26*b* cooperate with the looped ends 16*a* and 16*b* of the hinge rod 16 to generally maintain the hinge rod in fixed rotational relation to the snowshoe frame means. However, when the foot plate 18 has reached an upward angular position of approximately 45° relative to the snowshoe frame, at which time the bridle cable 60 prevents further upward pivotal movement of the foot plate about the hinge rod, the hinge rod straps 26*a* and 26*b* undergo a twisting action. The hinge rod straps resist such twisting action and thereby serve as a further shock absorber element in resisting upward movement of the foot plate relative to the frame means. This action further enhances the shock absorber characteristics of the snowshoe.

By creating increased resistance to pivotal movement of the foot plate about the hinge rod when the foot plate has reached an upward pivotal angle of approximately 45° relative to the snowshoe frame, a snowshoer can readily raise the snowshoe from the snow surface with the frame and floatation means remaining in relatively fixed relation to the user's foot. This permits backward movement or stepping without the tail end of the snowshoe frame dropping into the snow and inhibiting backstepping. This is particularly desirable when the snowshoer is confronted with an obstacle such as a fallen tree or the like, termed a deadfall, which is covered by loosely packed snow so that the snowshoer could drop downwardly into a pocket or void in the powder snow. Upon approaching such an obstacle, the snowshoer should immediately change direction as by backstepping.

Figure 7:
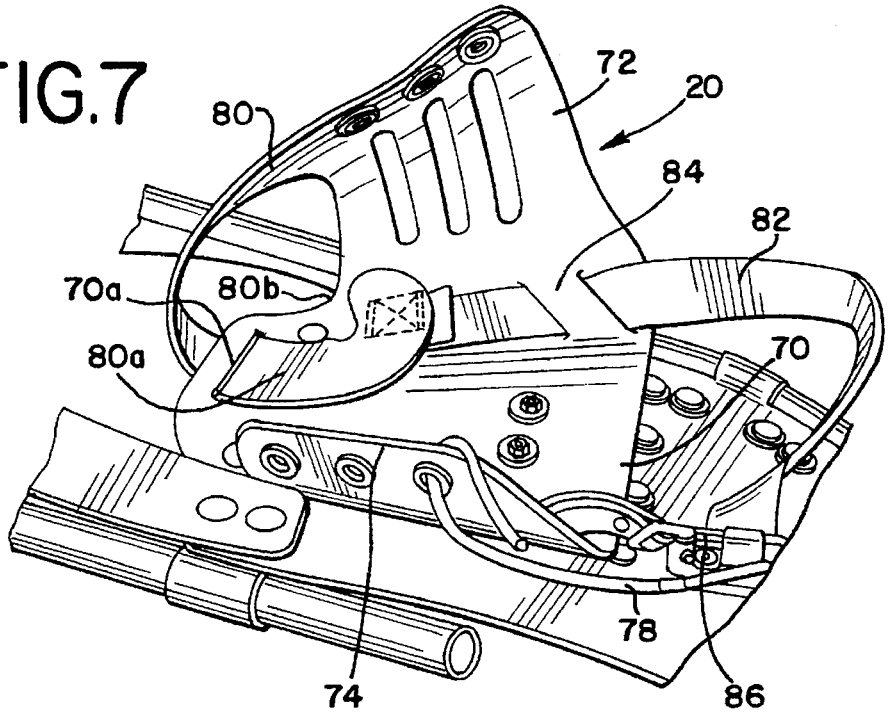
FIG. 7 is a fragmentary perspective view illustrating the binding carried by the foot plate.

Referring to FIG. 7, the binding means 20 is preferably made of a sheet material similar to the sheet material from which the floatation means 14 is made so as to be impervious to snow and water while providing sufficient strength and resistance to abrasion. The binding means 20 may be formed from a single pattern of sheet material so as to define a central panel portion 70 which is secured to the upper surface of the planar portion 18*a* of the foot plate 18, as through the rivets 43 or the like, and the screws 46. A pair of laterally opposite generally longitudinally extending wing panels 72 and 74 are preferably formed integral with the central panel portion 70 of the binding and are of sufficient length to cooperatively wrap around the forward portion of a boot or the like such as indicated at 76 in FIG. 8. A plurality of eyelets are formed in the outer marginal regions of the wing panels 72 and 74 to receive a draw string 78 for securing of the wing panels tightly about the boot.

A forwardly extending elongated tongue or toe piece 80 is preferably formed integral with the upper region of the wing panel 72 and has a forward end portion 80*a* which is slidable through a transverse slot or slot 70*a* in the forward end of the central panel 70 so as to overlie the central panel. The end 80*a* of the toe piece 80 is curved laterally at 80*b* to extend to one of two lateral margins of the central panel portion 70 and is connected to one end of a heel strap 82 which passes through a loop 84 formed through the lower region of the wing panel 72. In operation, with the toe portion of the boot 76 positioned with its sole above the central panel 70 of the binding means 20, the heel strap 82 is pulled rearwardly to snugly engage the toe piece 80 with the toe of the boot and the heel strap is secured about the heel portion of the boot by a suitable buckle 86. The wing panels 72 and 74 are then secured about the boot by the drawstring 78. In this manner, the boot is firmly retained longitudinally and laterally within the binding means 20. The longitudinal attachment means combines two components, the heel strap and the toe piece into one adjustment strap thereby simplifying attachment.

Having thus described a preferred embodiment of a snowshoe in accordance with the present invention, it will be appreciated that the snowshoe may be readily adapted for use in backcountry powder snow through the provision of a relatively thin wall bearing sleeve or hinge rod bushing 50 so as to enable relatively free pivotal relation between the foot plate 18 and the snowshoe frame, thereby enabling articulation of the user's foot and leg without appreciable lifting of the snowshoe. Should lifting of the snowshoe occur while traversing powder snow, the powder which accumulates on the tail end of the snowshoe may be readily discharged between the marginal edges of the floatation sheet material and the rearward portion of the perimeter frame, with the rearward portion of the floatation sheet material rearwardly from the strap fastener 32 opening downwardly to provide ready discharge of snow.

By arranging the interconnection of the foot plate 18 to the hinge rod 16 to provide controlled frictional resistance to relative rotation between the foot plate and hinge rod as described, rapid movement or slapping of the tail end of the snowshoe against the user's heel can be significantly inhibited or substantially prevented, and the toe portion of the snowshoe prevented from engaging the ankle or shin of the user. This is particularly desirable when jogging or running on the snowshoe. Each of the elements of the shock absorber may be used independently to provide resistance to rotation, or cooperatively to accomplish the same purpose. The shock absorber characteristics of the snowshoe can also be controlled to stabilize the snowshoe frame relative to the foot plate and user's leg so as to provide improved re-engagement of the snowshoe with the snow surface at the conclusion of each forward step or stride of the jogger or runner. Additionally, the bridle strap 60 prevents the foot plate from pivoting upwardly beyond an angle of approximately 45° relative to the snowshoe frame, thereby facilitating lifting of the snowshoe and preventing the toe portion of the snowshoe from engaging the ankle or shin of the user while running flat out. Slapping of the tail end of the snowshoe against the user's heel can be significantly inhibited or substantially prevented. The binding toe piece 80 facilitates firm longitudinal retention of the user's boot within the binding, thus eliminating any looseness which could cause fatigue during snowshoeing, and simplifies the attachment by adjusting two binding components, the toe piece heel strap, through adjustment of only the strap.

While a preferred embodiment of the snowshoe in accordance with the present invention has been illustrated and described, it will be obvious to those skilled in the art that changes and modifications may be made therein without departing from the invention in its broader aspects. Various features of the invention are defined in the following claims.

What is claimed is:

1. A snowshoe comprising, in combination, a frame defining a longitudinal axis of the snowshoe, floatation means carried by said frame for enabling support of the snowshoe on snow, a hinge rod secured to said frame in transverse relation thereto, and foot plate means pivotally supported on said hinge rod and carrying binding means for attaching the snowshoe to a user's foot, said foot plate means being pivotally movable between a lower position generally coplanar with said frame and an upward pivotal position relative to said frame, said hinge rod and foot plate means defining mutually interacting surface means to vary frictional resistance to pivotal movement of said foot plate means about said hinge rod as it approaches said upward pivotal position.

2. A snowshoe as defined in claim 1 including a bearing sleeve interposed between said hinge rod and said foot plate means.

3. A snowshoe as defined in claim 2 wherein said hinge rod includes at least one cam surface cooperative with said foot plate means to vary frictional resistance to upward pivotal movement of said foot plate means about said hinge rod as said foot plate means approaches said upward pivotal position.

4. A snowshoe as defined in claim 3 wherein said hinge rod has opposite ends defined by looped connecting ends, and including hinge straps connecting said connecting ends to said frame.

5. A snowshoe as defined in claim 3 wherein said hinge rod has a non-circular transverse cross-sectional configuration defining said at least one cam surface thereon, said cam surface cooperating with said bearing sleeve and said foot plate means to define shock absorber means operative to vary frictional resistance to upward pivotal movement of said foot plate means on said hinge rod as said foot plate means approaches said upward pivotal position.

6. A snowshoe as defined in claim 3 wherein said foot plate means includes a retainer plate which partially encircles said hinge rod and bearing sleeve to enable pivotal movement of said foot plate means about said hinge rod between said lower position generally coplanar with said frame and said upward pivotal position forming an included angle of approximately 45° with said frame, said retainer plate defining a gap in predetermined relation to said cam surface so as to vary frictional resistance to upward pivotal movement of said foot plate means as it approaches said upward pivotal position.

7. A snowshoe as defined in claim 6 including a pair of hinge rod straps interconnecting opposite ends of said hinge rod to said frame, said hinge rod straps being operative to undergo twisting in a manner to further increase resistance to upward pivotal movement of said foot plate means beyond said upward pivotal position.

8. A snowshoe as defined in claim 1 wherein said foot plate means comprises a foot plate having cleats carried on a lower surface thereof adapted to contact a surface on which the snowshoe is supported.

9. A snowshoe as defined in claim 1 wherein said binding means includes a toe piece adapted to engage the forward toe end of a shoe when disposed within said binding, and a heel strap adapted to encircle the heel of the shoe, said heel strap being connected to said toe piece so that snugly securing said heel strap about the heel of the shoe simultaneously draws said toe piece snug against the toe end of the shoe.

10. A snowshoe comprising, in combination, a frame, a foot plate pivotally supported on said frame, said frame including a forward end frame portion, said frame extending longitudinally rearwardly from said forward end portion, said forward end portion connected to an inner side rail portion and an outer side rail portion, said inner and outer side rail portions having rearward ends, said inner side rail portion including an angled portion wherein said inner side rail portion curves inwardly substantially more than said outer side rail portion, said side rail portions converge to a substantially greater degree at said angled portion than immediately rearward of said angled portion to provide a runner cutout, said runner cutout having an inner side rail portion being formed in closer spaced relation to said outer side rail portion rearwardly of said angled portion than forwardly of said angled portion to provide a reduced width of said inner and outer side rail portions at said rearward ends and a floatation member secured internally of said frame and extending substantially the full length of said frame.

11. A snowshoe as defined in claim 10 wherein said flotation member comprises a water impermeable sheet material having a perimeter edge generally paralleling said frame perimeter, said flotation member comprising means for facilitating discharge of snow accumulated on a tail end of the snowshoe when lifted from a snow surface.

12. A snowshoe as defined in claim 11 wherein said floatation member has a tail end portion free to drop below said frame in a manner to release snow accumulated on said tail end portion when the snowshoe is lifted from a snow surface.

13. A snowshoe as defined in claim 12 wherein said tail end portion of said floatation member is operative to engage an underside of a tail end of said frame when said frame is supported on a snow surface.

14. A snowshoe as defined in claim 12 including strap means interconnected to a tail end of said frame and to said floatation member at a point spaced forwardly from a rearward edge thereof, said tail end portion of said floatation member extending rearwardly from said point of connection to said strap.

15. A snowshoe as defined in claim 10 wherein said inner and outer side tail portions terminate at said rearward ends in a tail end frame portion.

16. A snowshoe as defined in claim 10 wherein said inner and outer side rail portions are substantially parallel immediately rearward of said angled portion.

17. A snowshoe as defined in claim 10 wherein said inner and outer side rail portions are substantially parallel immediately forward of said angled portion.

18. A snowshoe comprising, in combination, a frame defining a longitudinal axis with a tail end and a forward end and a horizontal axis with two sides and forming a perimeter of the snowshoe, floatation means carried by said frame for supporting the snowshoe on snow, said floatation means comprising a water impermeable sheet member having a perimeter edge generally paralleling said frame perimeter, said floatation member having a floatation portion released from the frame to provide means for dropping said floatation portion below the frame and said floatation portion generally supporting the snowshoe on the snow and to release snow accumulated on said floatation portion when the snowshoe is lifted from a snow surface.

19. A tail end snow release snowshoe comprising a snowshoe as defined in claim 18 wherein said floatation portion is further defined as a tail end portion of said floatation member.

20. A side snow release comprising a snowshoe as defined in claim 18 wherein said floatation portion is further defined as a side perimeter edge portion of said floatation member.

21. A snowshoe as defined in claim 18 wherein said flotation portion is operative to engage an underside of said frame.

22. A snowshoe as defined in claim 18 including a strap connected to said frame and interconnected to said floatation member at a point spaced inwardly from said frame, said floatation portion extending outwardly from said point of interconnection.

23. A snowshoe comprising:

a) a frame forming a perimeter of a snowshoe and defining a longitudinal axis with a forward end and a tail end with floatation means carried by said frame for enabling support of the snowshoe on snow, b) a foot plate supported on said frame and pivotally movable between a lower position generally coplanar with said frame and an upward pivotal position relative to said frame, c) said foot plate carrying binding means for attaching the snowshoe to a user's foot, d) said foot plate including foot plate means for resistance to upward pivotal movement of said foot plate as it approaches said upward pivotal position, e) said foot plate means providing a pivotal resistance sufficient to lift said tail end off the ground when less than a predetermined force is exerted on said frame and said foot plate approaches said upward pivotal position during a forward stepping action as the forward end of said frame lifts off the ground, and e) said foot plate means further providing a pivotal resistance wherein said foot plate pivots beyond said upward pivotal position without increased resistance and only if more than said predetermined force is exerted on the frame.

24. A snowshoe with bushing means for resistance to snowshoe pivotal movement comprising the snowshoe of claim 23 further including:

a) hinge rod secured to said frame in transverse relation thereto, b) said foot plate pivotally supported on said hinge rod, and c) said foot plate means for resistance including a bearing sleeve interposed between said hinge rod and said foot plate whereby snowshoe bushing means for resistance to pivotal movement is accomplished.

25. A snowshoe with adjustable retainer means for resistance to snowshoe pivotal movement comprising the snowshoe of claim 23 further including:

a) a hinge rod secured to said frame in transverse relation thereto, b) said foot plate pivotally supported on said hinge rod, c) said foot plate means for resistance including a bearing sleeve interposed between said hinge rod and said foot plate, d) a retainer plate which partially encircles said hinge rod and said bearing sleeve, and e) said retainer plate having means for varying the frictional resistance to pivotal movement of said foot plate whereby adjustable retainer plate means for snowshoe resistance to pivotal movement is accomplished.

26. A snowshoe with adjustable means for resistance to snowshoe pivotal movement comprising the snowshoe of claim 23 further including said foot plate means having means for varying the frictional resistance to pivotal movement of said foot plate whereby adjustable retainer plate means for snowshoe resistance to pivotal movement is accomplished.

27. A snowshoe with a binding including a slotted toe piece with a curved end including:

a. a snowshoe, b. a binding attached to said snowshoe, c. said binding including a toe piece, d. said toe piece including a curved end, e. said binding including a central panel having two lateral margins, and f. said curved end extending to one of said lateral margins and not to the other of said lateral margins g. said central panel includes a slot, and h. said toe piece passes through said slot whereby a snowshoe binding slotted toe piece with a curved end is accomplished.

28. The snowshoe of claim 27 further including a heel strap connected to said curved end.

* * * * *

Disclaimer 5,659,981—Jeffrey T. Liauaud, Park Ridge, IL. SNOWSHOE. Patent dated August 26, 1997. Disclaimer filed June 9, 2008 by the assignee, Sherpa Snowshoes LLP.

Hereby enters this disclaimer to claims 10, 15, 16 and 17, of said patent.

(*Official Gazette October 7, 2008*)